US009546651B2

(12) United States Patent
Richter et al.

(10) Patent No.: US 9,546,651 B2
(45) Date of Patent: Jan. 17, 2017

(54) PUMP ARRANGEMENT COMPRISING A SAFETY VALVE ARRANGEMENT

(71) Applicant: Fraunhofer-Gesellschaft zur Foerderung der angewandten Forschung e.V., Munich (DE)

(72) Inventors: Martin Richter, Munich (DE); Martin Wackerle, Munich (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 456 days.

(21) Appl. No.: 14/027,522

(22) Filed: Sep. 16, 2013

(65) Prior Publication Data

US 2014/0178227 A1 Jun. 26, 2014

Related U.S. Application Data

(63) Continuation of application No. PCT/EP2012/076699, filed on Dec. 21, 2012.

(51) Int. Cl.
*F04B 39/10* (2006.01)
*F04B 43/04* (2006.01)
(Continued)

(52) U.S. Cl.
CPC ..... *F04B 39/10* (2013.01); *F04B 43/043* (2013.01); *F04B 45/047* (2013.01); *F04B 53/106* (2013.01); *F04B 53/1077* (2013.01)

(58) Field of Classification Search
CPC ..... F04B 39/10; F04B 43/043–43/046; F04B 45/043; F04B 45/047; F04B 53/106; F04B 53/1067; F04B 53/1077; F04B 53/1092; F04B 53/001; F04B 53/004
(Continued)

(56) References Cited

U.S. PATENT DOCUMENTS 3,416,724 A * 12/1968 Lenkei ..... F04B 39/1093 137/851
4,555,719 A * 11/1985 Arway ..... B41J 2/17596 137/510
(Continued)

FOREIGN PATENT DOCUMENTS

CN 1548737 A 11/2004
CN 101581291 A 11/2009
(Continued)

OTHER PUBLICATIONS

Official Communication issued in corresponding Chinese Patent Application No. 201280021022.5, mailed on Oct. 23, 2015.
(Continued)

*Primary Examiner* — Devon Kramer
*Assistant Examiner* — Joseph Herrmann
(74) *Attorney, Agent, or Firm* — Keating & Bennett, LLP

(57) ABSTRACT

A pump arrangement includes a microfluidic pump having a pump inlet and a pump outlet. The pump arrangement further includes a safety valve arrangement having first safety valve, the first safety valve being arranged between the pump outlet and an outlet of the pump arrangement and including a first valve seat and a first valve lid. The outlet of the pump arrangement and a first fluid region are formed in a first part of the pump arrangement, wherein the first valve lid is formed in a second integrated part of the pump arrangement, and wherein the first valve seat, the pump outlet and the pump inlet are patterned in a second surface of a third integrated part of the pump arrangement. The first fluid region is adjacent to the first valve lid, wherein a pressure in the first fluid region has a closing effect on the first safety valve.

11 Claims, 4 Drawing Sheets

(51) Int. Cl.
*F04B 45/047* (2006.01)
*F04B 53/10* (2006.01)

(58) Field of Classification Search
USPC ..... 417/413.2, 413.3, 312
See application file for complete search history.

(56) References Cited

U.S. PATENT DOCUMENTS

| | | | | |
|---|---|---|---|---|
| 5,759,014 | A | 6/1998 | Van Lintel | |
| 7,104,768 | B2 * | 9/2006 | Richter | F04B 43/046 417/413.2 |
| 7,284,966 | B2 * | 10/2007 | Xu | F04B 19/006 417/395 |
| 8,066,494 | B2 * | 11/2011 | Kamitani | F04B 43/046 417/413.2 |
| 2006/0027772 | A1 | 2/2006 | Richter et al. | |
| 2010/0028170 | A1 | 2/2010 | Schneeberger et al. | |
| 2010/0078584 | A1 * | 4/2010 | Van Den Bijgaart | F15C 5/00 251/331 |
| 2010/0290935 | A1 * | 11/2010 | Richter | F04B 43/043 417/413.2 |

FOREIGN PATENT DOCUMENTS

| | | | |
|---|---|---|---|
| EP | 1 576 294 | B1 | 8/2006 |
| JP | 2001-317647 | A | 11/2001 |
| JP | 2010-502873 | A | 1/2010 |
| JP | 2012-217684 | A | 11/2012 |
| WO | 95/08716 | A2 | 3/1995 |
| WO | 01/21988 | A1 | 3/2001 |

OTHER PUBLICATIONS

English Translation of Official Communication issued in corresponding Japanese Patent Application No. 2014-552557, mailed on Dec. 16, 2014.

Official Communication issued in International Patent Application No. PCT/EP2012/076699, mailed on Mar. 26, 2013.

* cited by examiner

PUMP ARRANGEMENT COMPRISING A SAFETY VALVE ARRANGEMENT

CROSS-REFERENCE TO RELATED APPLICATIONS

This application is a continuation of copending International Application No. PCT/EP2012/076699, filed Dec. 21, 2012, which is incorporated herein by reference in its entirety.

BACKGROUND OF THE INVENTION

Embodiments of the present invention relate to a pump arrangement and in particular to a pump arrangement comprising a microfluidic pump and a safety valve arrangement at the pump outlet of the microfluidic pump. The safety valve arrangement may comprise a first safety valve for a free flow protection in a backward direction (with respect to the fluid pumping direction of the microfluidic pump) and, optionally, an additional second safety valve for a free flow protection in a forward direction of the microfluidic pump.

Known micropumps are problematic in that a free flow through the micropumps may take place when an overpressure or a positive pressure is applied to the inlet or outlet of the micropump and there is no operating voltage applied to the micropump. In order to avoid an uncontrolled flow through the micropump, a check valve may be respectively arranged at the inlet and the outlet of the micropump. However, in specific applications, which need a tight pump arrangement especially in the backward direction with respect to the pumping direction of the micropump, e.g. in (implantable) drug delivery systems or micropumps for tires, the backward free flow or leakage of the fluid has to be very low, for example 0.1 μl/hour. However, this is hardly achievable with conventional silicon check valves.

Moreover, micropump arrangements according to known technology are disadvantageous in that additional, separate components are needed which in turn results in increased space and cost requirements. Additionally, conventional pump arrangements exhibit a relatively large dead volume, wherein again fluidic fittings are needed.

Consequently, there is a demand for a pump arrangement in which an unwanted free flow in a backward direction (with respect to the pumping direction) or in both directions can be reliable prevented in an inactivated state of the micropump and which comprises a inexpensive design or setup and provides a small dead volume.

SUMMARY

According to an embodiment, a pump arrangement may have: a microfluidic pump comprising a pump inlet and a pump outlet, wherein the microfluidic pump is configured to pump a fluid from the pump inlet to the pump outlet, wherein the pump inlet and an inlet of the pump arrangement are fluidically connected; a safety valve arrangement having first safety valve, the first safety valve being arranged between the pump outlet and an outlet of the pump arrangement and comprising a first valve seat and a first valve lid; wherein the outlet of the pump arrangement and a first fluid region are fluidically connected and are formed in a first part of the pump arrangement, wherein the first valve lid is formed in a second integrated part of the pump arrangement, wherein the first valve seat, the pump outlet and the pump inlet are patterned in a second surface of a third integrated part of the pump arrangement, and wherein the second integrated part is arranged between the first integrated part and the third part of the pump arrangement, wherein the first fluid region is adjacent to the first valve lid, and wherein a pressure in the first fluid region has a closing effect on the first safety valve.

Moreover, the safety valve arrangement may comprise a second safety valve, wherein the second safety valve is arranged downstream to the pump outlet and comprises a second valve seat and a second valve lid. The second valve seat is patterned in the second surface of the third integrated part of the pump arrangement, wherein the second valve lid is formed in a second integrated part of the pump arrangement, and wherein the inlet of the pump arrangement and a second fluid region, which are fluidically connected, are further formed in the first part of the pump arrangement, and wherein the second fluid region is adjacent to the second valve lid, and wherein a pressure in the second fluid region has a closing effect on the second safety valve.

In accordance with embodiments of an inventive pump arrangement, the safety valve arrangement is integrated directly to a microfluidic pump. The safety valve arrangement comprises a first safety valve for a backward direction (with respect to a pumping or fluid flow direction of the microfluidic pump) and, optionally, a second safety valve for a forward direction of the microfluidic pump.

In order to allow an inexpensive pump arrangement design exhibiting a small dead volume, the valve seat of the first (backward) safety valve for the backward direction, the pump outlet and the pump inlet are patterned in a surface of an integrated part of the microfluidic pump arrangement. Moreover, in the optional case of an implementation of a second (forward) safety valve for the forward direction, the valve seat of the second safety valve may be also patterned in the same surface of the integrated part of the microfluidic pump arrangement. Due to the fact that the outlet of the microfluidic pump and the valve seat of the first safety valve and, optionally, the valve seat of the second safety valve are formed in the same surface of the integrated part, the valve seat of the first safety valve and the valve seat of the optionally arranged second safety valve may be formed directly at the outlet of the microfluidic pump, thereby achieving a small dead volume and an inexpensive design of the resulting microfluidic pump arrangement.

In embodiments of the invention, the pump inlet is additionally patterned in the same surface. Moreover, the pump outlet may also be patterned in the same surface and fluidically connected to a first fluid region of the pump arrangement supporting a closing effect on the first safety valve.

According to embodiments of the invention, the safety valve arrangement is implemented a double safety valve for the backward direction and for the forward direction of the microfluidic pump, wherein the double safety valve is arranged at a position downstream to the outlet of the microfluidic pump.

According to embodiments of the invention, the respective valve lid of the first and second safety valve may be formed from the same sealing member or gasket, for example in the form of a (e.g. contiguous) silicone diaphragm. To be more specific, the same gasket or sealing element can be used for both safety valves by means of arranging another "U"-turn inside the third integrated part (e.g. a patterned silicon layer/chip) in addition to "U"-turn of the first safety valve. In other words, both U-turns for the first and second safety valve may be folded around the same silicon chip. Based on this implementation, a "double" safety valve arrangement may be implemented downstream to the outlet of the microfluidic pump without additional chip size, additional process steps and/or without additional clamping parts.

As the valve seat of the first and second safety valve may be formed by means of a contiguous gasket in the form of a silicone diaphragm, a so-called soft-hard sealing (i.e. a soft silicone diaphragm abutting against the hard silicon chip) can be made fluidically tight to achieve the hard leakage specification in the backward direction. Thus, the inventive pump arrangement with the specific safety valve arrangement can be especially applied to all technical applications which need a fluidically tied pump at least in the backward direction (or in both directions), e.g. for "implantable" drug delivery systems, micropumps for tires, etc.

BRIEF DESCRIPTION OF THE DRAWINGS

Embodiments of the present invention will be detailed subsequently referring to the appended drawings, in which.

DETAILED DESCRIPTION OF THE INVENTION

Before discussing the present invention in further detail using the drawings, it is pointed out that identical elements or elements having the same functionality or the same effect are provided with the same reference numbers in the figures so that the description of these elements having the same reference numbers and of the functionality thereof illustrated in the different embodiments is mutually exchangeable or may be applied to one another in the different embodiments.

Figure 1:
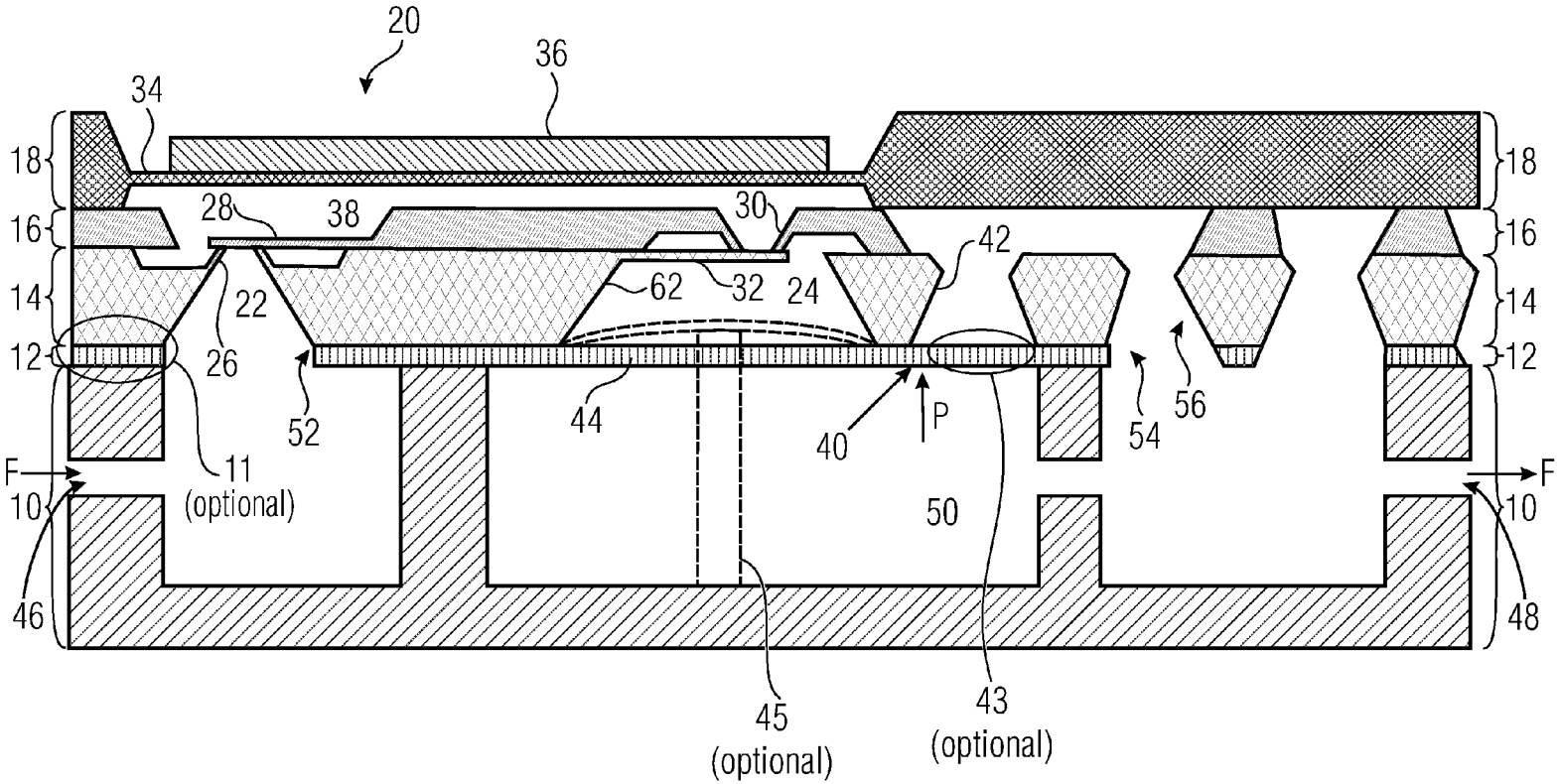
FIG. 1 shows a schematic cross-sectional view of a pump arrangement in accordance with an embodiment of the present invention.

As depicted in FIG. 1, a microfluidic pump arrangement having a microfluidic pump and a safety valve arrangement will be described, wherein the microfluidic pump is implemented by a micro-diaphragm pump comprising a passive check valve.

The microfluidic pump arrangement 1 may comprise five patterned layers 10, 12, 14, 16, 18 which are arranged one above the other and which are attached (sequentially) to one another. This stack of patterned layers will be subsequently referred as first layer 10, second layer 12, third layer 14, fourth layer 16 and fifth layer 18. With respect to the plane of projection in FIG. 1, the first layer 10 has a first (top) and a second (bottom) surface. The second layer 12 has a first (top) surface and a second (bottom) surface. The third layer 14 has a first (top) and a second (bottom) surface. The fourth layer 16 has a first (top) surface and a second (bottom) surface. The fifth layer 18 has a first (top) and a second (bottom) surface. According to embodiments, the first surface of the first layer 10 is mechanically connected to the second surface of the second layer 12. The first surface of the second layer 12 is mechanically connected to the second surface of the third layer 14. The first surface of the third layer 14 is mechanically connected to the second surface of the fourth layer 16. The first surface of the fourth layer 16 is mechanically connected to second surface of the fifth layer 18.

The microfluidic pump arrangement shown in FIG. 1 comprises a diaphragm pump 20 comprising a pump inlet 22 and a pump outlet 24. The pump inlet 22 and the pump outlet 24 are patterned in the second (bottom) surface of the third layer 14. The diaphragm pump 20 includes a passive check valve comprising a valve seat 26 and a valve flap 28, at the pump inlet 22. The valve seat 26 is patterned in the first (top) surface of the third layer 14 and the valve flap 28 is patterned in the fourth layer 16. Additionally, the microfluidic pump 20 includes a passive check valve comprising a valve seat 30 and a valve flap 32 at the pump outlet 24. The valve seat 30 is patterned in the fourth layer 16 and the valve flap 32 is patterned in the first (top) surface of the third layer 14.

Furthermore, the diaphragm pump 20 includes a pump diaphragm 34 patterned in the fifth part 18. A piezoceramic element 36 is attached to the pump diaphragm 34 such that, by actuating the piezoceramic element 36, a volume of a pump chamber 38 of the diaphragm pump 20 can be varied. For this purpose, suitable means (not shown) are provided for applying a voltage to the piezoceramic element 36 bonded to the pump diaphragm 34 and for deflecting the same from the position as shown in FIG. 1 to a position where the volume of the pump chamber 38 is reduced.

Moreover, the pump arrangement shown in FIG. 1 comprises a safety valve arrangement with a first safety valve 40 at the pump outlet 24, i.e. downstream to the pump outlet 24. The first safety valve 40 includes a safety valve seat 42 and a safety valve flap 44. The safety valve seat 42 is patterned in the bottom surface of the third layer 14. The safety valve flap 44 is formed by a part of the second layer 12 opposite the safety valve seat 42. The third layer 14 comprises a recess 62 which defines the valve chamber with the second layer 12 in the bottom surface thereof.

The pump arrangement shown in FIG. 1 includes a pump arrangement inlet 46 and a pump arrangement outlet 48. The pump arrangement outlet 48 is fluidically connected to a first fluid region 50. The pump arrangement inlet 46, the pump arrangement outlet 48 and the first fluid region 50 are patterned in the first layer 10. The first fluid region 50 thus abuts on the bottom of the second layer 12 such that a pressure $P_{50}$ in the fluid region 50 has a closing effect on the first safety valve 40. The pump arrangement inlet 46 is fluidically connected to the pump inlet 22 via a first opening 52 in the second layer 12. The first safety valve 40 is fluidically connected to a fluid channel 56, said fluid channel 56 in turn being fluidically connected to the outlet 48 via a second opening 54 in the second layer 12. In the embodiment shown, the fluid channel 56 is formed by corresponding patterns in the third layer 14 and the fourth layer 16. The outlet of the safety valve is patterned in the top surface of the third layer 14.

The pump arrangement inlet 46 and the pump arrangement outlet 48 may be provided with suitable fluid connectors which allow connecting further fluidic structures, such as, for example, so-called Luer connectors for connecting tubes and the like.

To summarize, the pump arrangement 1 of FIG. 1 comprises a microfluidic pump 20 having a pump inlet 22 and a pump outlet 24, wherein the microfluidic pump 20 is configured to pump the fluid F (in the forward or pumping direction) from the pump inlet 22 to the pump outlet 24, wherein the pump inlet 22 and the inlet 46 of the pump arrangement are fluidically connected. The safety valve arrangement having the first valve 40 is arranged downstream to the pump outlet 24, i.e. between the pump outlet 24 and the outlet 48 of the pump arrangement. The first safety valve 40 comprises the first valve seat 42 and the first valve lid 44. The first valve seat 42, the pump outlet 48 and the pump inlet 22 are patterned in the second surface of the third integrated part 14 of the pump arrangement 1. The first valve lid 44 is formed in the second integrated part 12 of the pump arrangement 1. The outlet 46 of the pump arrangement and the first fluid region 50, which are fluidically connected, are formed in the first part 10 of the pump arrangement 1. Moreover, the second integrated part 12 is arranged between the third integrated part 14 and the first part 10 of the pump arrangement so that the first fluid region 50 is formed adjacent to the first valve lid 44. In a basic or initial state, i.e. in a non-deflected or closed condition of the first valve lid, the first valve lid abuts against the first valve seat. As the first fluid region is adjacent to the first valve lid, a pressure $P_{50}$, e.g. a back pressure, applied (from the outside) into the outlet 48 of the pump arrangement, supports the closing effect on the first safety valve 40.

Figure 2:
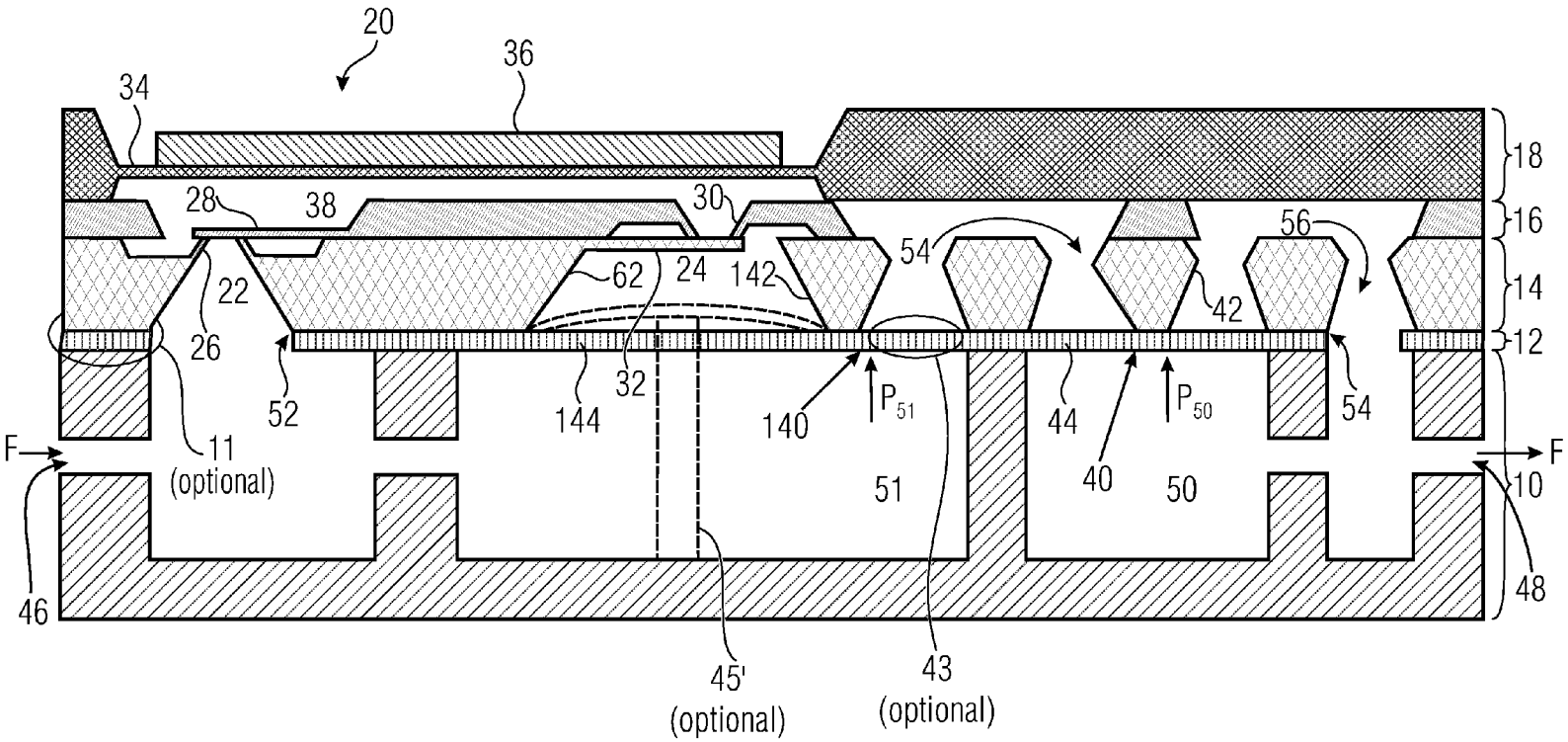
FIG. 2 shows a schematic cross-sectional view of a pump arrangement in accordance with a further embodiment of the present invention.

FIG. 2 shows a schematic cross-sectional view of a pump arrangement in accordance with a further embodiment of the present invention.

The microfluidic pump arrangement 2 of FIG. 2 may comprise five patterned layers 10, 12, 14, 16, 18 which are arranged one above the other and which are attached (sequentially) to one another (as already shown in FIG. 1).

The microfluidic pump arrangement 2 shown in FIG. 2 also comprises a diaphragm pump 20 having a pump inlet 22 and a pump outlet 24. The pump inlet 22 and the pump outlet 24 are patterned in the second (bottom) surface of the third layer 14. The diaphragm pump 20 includes a passive check valve comprising a valve seat 26 and a valve flap 28, at the pump inlet 22. The valve seat 26 is patterned in the first (top) surface of the third layer 14 and the valve flap 28 is patterned in the fourth layer 16. Additionally, the microfluidic pump 20 includes a passive check valve comprising a valve seat 30 and a valve flap 32 at the pump outlet 24. The valve seat 30 is patterned in the fourth layer 16 and the valve flap 32 is patterned in the first (top) surface of the third layer 14.

Furthermore, the diaphragm pump 20 includes a pump diaphragm 34 patterned in the fifth part 18. A piezoceramic element 36 is attached to the pump diaphragm 34 such that, by actuating the piezoceramic element 36, a volume of a pump chamber 38 of the diaphragm pump 20 can be varied. For this purpose, suitable means (not shown) are provided for applying a voltage to the piezoceramic element 36 bonded to the pump diaphragm 34 and for deflecting the same from the position as shown in FIG. 1 to a position where the volume of the pump chamber 38 is reduced.

In the following, additional structural elements are described which can be optionally added to the micropump arrangement 1 of FIG. 1.

Moreover, an optional sealing element 11 is schematically indicated in FIG. 1. This optional sealing element 11 is provided to obtain an increased fluid tightness and sealing between inner areas of the micropump arrangement 1 adjacent to one another or between inner areas of the micropump arrangement 1 and the environment. For this, the optional sealing elements 11 are provided, for example, at chamber-forming inner wall areas or at outer wall areas of the pump arrangement 1.

For a more detailed explanation of the implementation of the optional sealing elements 11 and their functionality, reference will be made below to FIGS. 3*a-f* and the associated description.

FIG. 1 further shows a stabilization element 43 for the second layer 12 implemented, for example, as silicone membrane 44. Thus, a (structured) metal membrane or metal layer can be inserted or embedded (molded) into the silicone material of the silicone membrane 12, wherein the metal membrane 43 has a higher rigidity and stability than the silicone material of the silicone membrane or the layer 12 for providing an stiffening effect to the second layer 12 or at least to portions of the second layer 12.

Moreover, FIG. 1 shows an optional biasing element 45, which is implemented, for example, to bias a portion of the second layer 12 in the area of the first fluid region 50 in the direction of the valve seat 42.

The additional optional biasing element 45 is provided to increase the tightness of the first safety valve 40 both at relatively high pressures (e.g. 0.5 to 2 Bar or above) and also at relatively low pressures (e.g. at 0.1 to 20 mBar) in the fluid path. By means of the optional biasing element 45, a slight upward biasing, i.e. in a direction to the valve seat 42, of the layer 12 can be obtained. In FIG. 1, an exemplary upward biasing of the layer 12 is indicated by a dashed line. The additional biasing element 45 can be implemented, for example, in the shape of a column at the first layer 10. For this, the biasing element 45 can be implemented integrally with the first layer 10. Alternatively, the optional biasing element 45 can also be implemented as a spring, rigid lug, etc. to establish a point-shaped, line-shaped or plane contact with the silicone material of the valve lid 44 and to bias the valve lid in the direction of the valve seat 42.

Moreover, the pump arrangement 2 shown in FIG. 2 comprises a safety valve arrangement with a first safety valve 40 and a second safety valve 140 downstream to the pump outlet 24. The first safety valve 40 includes a first safety valve seat 42 and a first safety valve flap 44. The safety valve seat 42 is patterned in the bottom surface of the third layer 14. The first safety valve flap 44 is formed by a part of the second layer 12 opposite the first safety valve seat 42. The third layer 14 comprises a recess 62 which defines the valve chamber with the second layer 12 in the bottom surface thereof. As shown in FIG. 2, the second safety valve 140 is also arranged downstream to the pump outlet 24, e.g. between the pump outlet 24 and the first safety valve 40. The second safety valve 140 comprises a second valve seat 142 and a second valve lid 144 patterned in the bottom surface of the third layer 14.

The pump arrangement shown in FIG. 2 further includes a pump arrangement inlet 46 and a pump arrangement outlet 48. The pump arrangement outlet 48 is fluidically connected to a first fluid region 50. The pump arrangement inlet 46 is fluidically connected to a second fluid region 51. The pump arrangement inlet 46, the pump arrangement outlet 48 and the first fluid region 50 are patterned in the first layer 10.

In the following in particular the additional elements of the safety valve arrangement of FIG. 2 when compared to the safety valve arrangement 1 of FIG. 1 and their functionality will be described in detail. To be more specific, the second safety valve 140 comprises the second valve seat 142 which is patterned in the second surface of the third integrated part 14 of the pump arrangement, wherein the second valve lid 144 is formed in a second integrated part 12 of the pump arrangement 2. The inlet 46 of the pump arrangement 2 and a second fluid region 51, which are fluidically connected, are further formed in the first part 10 of the pump arrangement 2. The second fluid region 51 is adjacent to the second valve lid 144, wherein a pressure $P_{51}$, e.g. a forward fluid pressure, in the second fluid region 51 supports a closing effect on the second safety valve 140. The second integrated part 12 of the pump arrangement 2 is a (e.g. contiguous) flexible layer or gasket which forms the first valve lid 44 and the second valve lid 144. The flexible layer 12 may comprise a silicon diaphragm for providing a soft sealing against the respective first valve seat 42 and/or second valve seat 142. Furthermore, it should be noted that the first fluid region 50 and the second fluid region 51 are spatially and fluidically separated in the pump arrangement 2, e.g. a pressure tight separation is arranged between the first and second fluid regions/chambers.

The first fluid region 50 thus abuts on the bottom of the second layer 12 at the first safety valve 40 such that a pressure $P_{50}$ (e.g. a back pressure) in the fluid region 50 has a closing effect on the first safety valve 40. The second fluid region 51 abuts on the bottom of the second layer 12 at the second safety valve 140 such that a pressure $P_{51}$ (e.g. a forward pressure) in the fluid region 51 has a closing effect on the second safety valve 140. The pump arrangement inlet 46 is fluidically connected to the pump inlet 22 via a first opening 52 in the second layer 12. The second safety valve 140 is fluidically connected, via a fluid channel 57 in form of a U-turn, to the first safety valve 40.

In the embodiment shown, the fluid channel 57 is formed by corresponding patterns in the third layer 14 and the fourth layer 16. The first safety valve 40 is fluidically connected to a fluid channel 56, said fluid channel 56 in turn being fluidically connected to the outlet 48 via a second opening 54 in the second layer 12. In the embodiment shown, the fluid channel 56 is formed by corresponding patterns in the third layer 14 and the fourth layer 16. The outlet of the safety valve is patterned in the top surface of the third layer 14.

With the pump arrangement in operation, as is shown in FIGS. 1 and 2, the pump diaphragm 34 is actuated departing from the state shown in FIGS. 1 and 2 so that the volume of the pump chamber 38 is decreased. This generates a positive pressure in the pump chamber 38 which, on the one hand, opens the check valve at the pump outlet 24, and on the other hand, exerts pressure on the safety valve flap 44. At the same time, the positive pressure in the pump chamber 38 has a closing effect on the check valve at the inlet of the pump chamber. Thus, during actuation of the pump diaphragm 34, which is referred to as pump stroke, fluid is conveyed through the check valve at the pump outlet 24 and the safety valve 40 to the pump arrangement outlet 48.

In a subsequent suction stroke where the pump diaphragm 34 is brought back to the position shown in FIGS. 1 and 2, a negative pressure which has a closing effect on the check valve at the pump outlet 24 and an opening effect on the check valve at the pump inlet 22, forms in the pump chamber 38. Thus, during this suction stroke, fluid is sucked in through the pump arrangement inlet 46.

In order to effect a volume flow from the pump arrangement inlet to the pump arrangement outlet, the piezoceramic 36 can be provided with a voltage periodically, exemplarily by a pulsed signal. Depending on the frequency of the actuating voltage applied and a stroke volume of the pump diaphragm 34, a desired delivery rate can be achieved.

Referring to the embodiments of FIGS. 1 and 2, the first safety valve 40 of the safety valve arrangement functions as follows. When the pump 22 is not in operation, flow through the pump arrangement from the pump outlet 48 to the pump inlet 46 (in a backward direction) is prevented, since a back pressure $P_{50}$ acting (from the outside) into the outlet 48 of the pump arrangement also acts on the bottom of the safety valve flap 44 via the first fluid region 50 and at the same time acts on the top of the safety valve flap 44 via the channel 56. This back pressure has also an closing effect on both check valves at the pump outlet 24 and at the pump inlet 22. Thus, in an un-actuated state an undesired free flow in the backward can be prevented reliably with a back pressure at the pump arrangement outlet 48.

Referring to the optional embodiment of FIG. 2, the additional safety valve 140 of the safety valve arrangement functions as follows. When the pump 22 is not in operation, flow through the pump arrangement from the pump inlet 46 to the pump outlet 48 (in a forward direction) is prevented, since a positive pressure $P_{51}$ at the pump arrangement inlet 46 acts on the bottom of the safety valve flap 44 via the fluid region 51 and at the same time acts on the top of the safety valve flap 44 via the pump 20, since this positive pressure has an opening effect on both check valves at the pump inlet 22 and at the pump outlet 24. The force acting on the safety valve flap 44 from below by the positive pressure $P_{51}$ at the inlet is greater than the force acting on it from above, so that a positive pressure at the inlet 46 has a closing effect on the safety valve flap 44. The force acting from below is greater, since the pressure from below acts on a greater area than the pressure from above. More precisely, the pressure from below acts on the entire moveable flap area, whereas the pressure from above does not act on the region which is covered by the valve seat 42. Thus, in an un-actuated state free flow in the forward direction can be prevented reliably with a positive pressure at the pump arrangement inlet.

In the following, additional structural elements are described which can be optionally added to the micropump arrangement 2 of FIG. 2.

Moreover, an optional sealing element 11 is schematically indicated in FIG. 2. This optional sealing element 11 is provided to obtain an increased fluid tightness and sealing between inner areas of the micropump arrangement 2 adjacent to one another or between inner areas of the micropump arrangement 2 and the environment. For this, the optional sealing elements 11 are provided, for example, at chamber-forming inner wall areas or at outer wall areas of the pump arrangement 1.

For a more detailed explanation of the implementation of the optional sealing elements 11 and their functionality, reference will be made below to FIGS. 3*a-f* and the associated description.

FIG. 2 further shows a stabilization element 43 for the second layer 12 implemented, for example, as silicone membrane 144. Thus, a (structured) metal membrane or metal layer can be inserted or embedded (molded) into the silicone material of the layer 12, wherein the metal membrane 43 has a higher rigidity and stability than the silicone material of the silicone membrane or the layer 12 for providing an stiffening effect to the second layer 12 or at least to portions of the second layer 12.

Moreover, FIG. 2 shows an optional biasing element 45', which is implemented, for example, to bias a portion of the second layer 12 in the area of the first fluid region 51 in the direction of the valve seat 142.

The additional optional biasing element 45' is provided to increase the tightness of the second safety valve 140 (of FIG. 2) both at relatively high pressures (e.g. 0.5 to 2 Bar or above) and also at relatively low pressures (e.g. at 0.1 to 20 mBar) in the fluid path. By means of the optional biasing element 45', a slight upward biasing, i.e. in a direction to the valve seat 142, of the layer 12 can be obtained. In FIG. 1, an exemplary upward biasing of the layer 12 is indicated by a dashed line. The additional biasing element 45' can be implemented, for example, in the shape of a column at the first layer 10. For this, the biasing element 45' can be implemented integrally with the first layer 10. Alternatively, the optional biasing element 45' can also be implemented as a spring, rigid lug, etc. to establish a point-shaped, line-shaped or plane contact with the silicone material of the valve lid 144 and to bias the valve lid in the direction of the valve seat 142.

Moreover, the pump arrangement 2 of FIG. 2 may comprise an additional biasing element (not shown in FIG. 2) for the first safety valve 40 in order to increase the tightness of the first safety valve 40. The additional biasing element may be arranged in the first fluid region 50 and may have the same structure and functionality as the biasing element 45 for the first safety valve 40 of FIG. 1.

The pump arrangement shown in FIG. 1 or 2 may comprise a peristaltic micropump. Inventive pump arrangements are suitable for a plurality of applications. Subsequently, only exemplarily, applications wherein preventing free flow with a positive pressure at the pump inlet is important will be mentioned. Such applications embodiments of inventive pump arrangements are suitable for, exemplarily include methanol feed pumps in fuel cell systems, infusion pumps, implantable drug delivery systems, portable drug delivery systems, systems for moistening respiratory air, systems for dosing anesthetics, and micropumps for tires, etc.

A peristaltic micropump comprising normally open valves allows implementing a pump having a high compression ratio, which in turn is of advantage for a bubble-tolerant operation. Alternatively, an inventive pump arrangement may also comprise a peristaltic micropump comprising normally closed active valves at the pump inlet and/or the pump outlet.

The components or layers 10, 12, 14, 16, 18 of the inventive pump arrangement, such as, for example, the second layer 12 and the third layer 14, may be connected to one another using any known joining or bonding techniques, such as, for example, by gluing, clamping or connecting methods not having a joining layer.

In embodiments of the invention, the second integrated part of the pump arrangement is a layer of basically uniform thickness arranged between the first integrated part and the third part and separating same. This second integrated part may comprise at least one opening via which the pump inlet is fluidically connected to the fluid region representing an inlet fluid region of the pump arrangement. In embodiments in which an outlet fluid region of the pump arrangement is also formed in the third part, the second integrated part may comprise another opening by which an outlet of the safety valve is fluidically connected to the outlet of the pump arrangement. A second integrated part of basically uniform thickness which, as has been described, may be provided with openings allows easy manufacturing of an inventive pump arrangement comprising a reduced number of elements. In alternative embodiments, the second integrated part may be formed in the region of the safety valve only.

Embodiments of inventive pump arrangements may be implemented using different pumps, such as, for example, diaphragm pumps comprising passive check valves at the pump inlet and at the pump outlet, or peristaltic pumps. Embodiments of the present invention are particularly suitable for implementing micropumps in which a pump volume pumped during one pump cycle may be in the range of microliters and below. Furthermore, relevant dimensions of such a micropump, such as, for example, the pump stroke of a pump diaphragm or the thickness of a pump diaphragm, may be in the range of micrometers.

The present invention provides a pump arrangement wherein a pump and a safety valve are integrated in one element which may be implemented using a small number of parts. Embodiments of the invention may implement a pump arrangement element being formed of five or six individual parts or layers, thus considering a pump diaphragm part including the respective piezoceramic and corresponding fittings or connections as one part.

Embodiments of the present invention provide a pump arrangement chip formed of several patterned layers arranged one above the other which form a pump and a safety valve integrated at the pump outlet. Thus, embodiments of the invention do not necessitate separate fluidic connections between pump and valve. Both dead volume and space requirements can be minimized in embodiments of the invention. Apart from an easy implementation, embodiments of the invention allow size, weight and cost savings.

In accordance with embodiments of the inventive pump arrangement, a back pressure at the pump arrangement outlet has a closing effect on the safety valve so that a flow in the direction from the outlet to the inlet may be avoided effectively in an un-actuated state.

In accordance with embodiments of the inventive pump arrangement, moreover a positive pressure at the pump arrangement inlet has a closing effect on the safety valve so that a flow in the direction from the inlet to the outlet may be avoided effectively in an un-actuated state.

In the following, exemplary implementations of the optional sealing element 11 are illustrated based on sectional views in FIGS. 3*a-f*.

According to embodiments of the invention, the layer or part 12, which forms the respective valve lid of at least one of the first and second safety valve, may comprise a silicone diaphragm for providing a so-called soft-hard sealing, i.e. a soft silicone diaphragm abutting against the hard silicon chip of the first layer 10 and/or second layer 14.

Figure 3C:
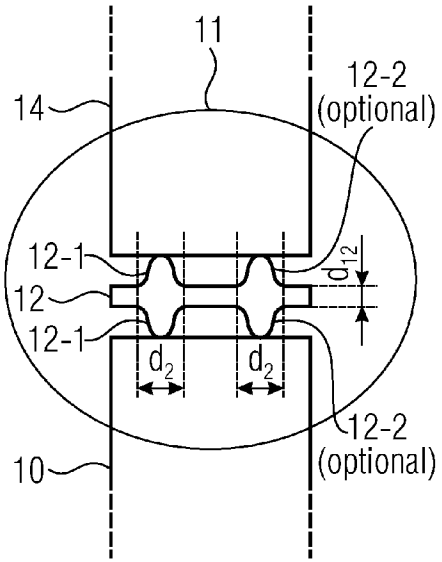
FIG. 3*a-g* shows schematic cross-sectional views of an optional sealing element and an optional stiffing element in accordance with an embodiment of the present invention.
Figure 3B:
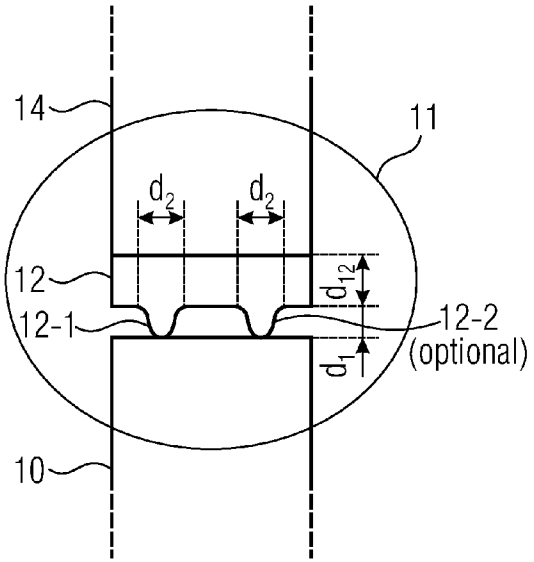
Figure 3A:
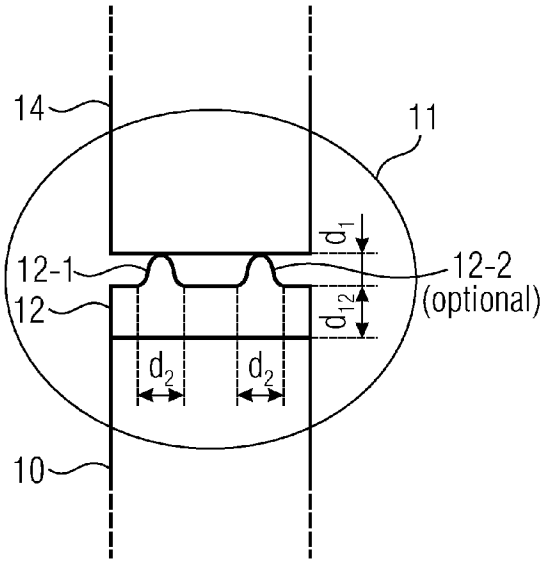

As illustrated in FIG. 3*a*, the layer 12, which is, for example, implemented as a silicone membrane, can comprise one or several (elongated) elevations or thickenings 12-1, 12-2 (i.e. a ring or line seal, e.g. in the form of a bulge, circumferential ridge or ring) at positions where an improved sealing of a wall area is necessitated, which effect, when joining the layer 12 between layers 10 and 14, an increased contact pressure to the layer 12 and thus the enhanced sealing.

As illustrated in FIG. 3*a*, the additional sealing element 11 comprises at least one (elongated) elevation 12-1 and optionally one or several further elevations 12-2. This optional sealing element 11 is now, for example, provided at positions where a high pressure difference can occur, i.e. at positions between adjacent inner volumes (chambers) of the micropump arrangement 1 or between inner areas of the micropump arrangement 1 and the environment.

As illustrated in FIG. 3*b*, the additional elevation 12-1 (and the further optional elevations 12-2) in the layer 12 can be implemented in the direction of the adjacent layer 14. Likewise, the additional elevations or thickenings for forming compression seals can also be implemented in the direction of the first layer 10 (cf. FIG. 3*b*) or optionally in the direction of both adjacent layers 10 and 14 (cf. FIG. 3*c*).

Figure 3F:
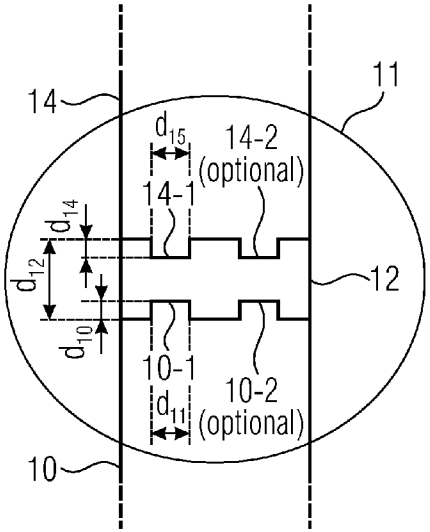
Figure 3E:
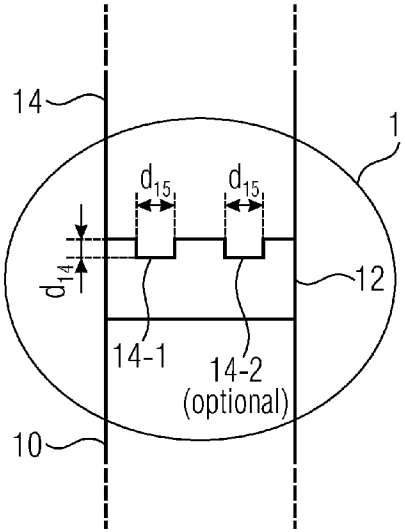
Figure 3D:
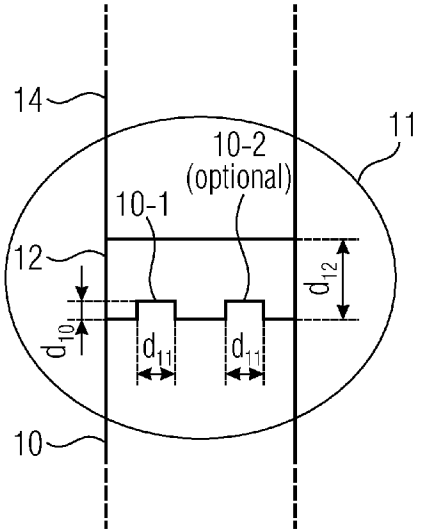

Alternatively, the additional elevations or thickenings can also be formed at the adjacent layers 10 or 14, as illustrated in FIGS. 3*d-f*. As illustrated in FIG. 3*d*, an at least one elevation 10-1 is formed at a surface portion of the first layer 10, which is adjacent to and in contact with the silicone membrane 12. Alternatively, an at least one additional elevation 14-1 can also be implemented at a surface portion of the third layer 14 (cf. FIG. 3*e*), which is adjacent to and in contact with the silicone membrane 12. Alternatively, the optional sealing element 11 can also comprise at least one additional elevation 10-1 in the first layer 10 and additionally at least one elevation 14-1 in the third layer 14. Here, elevations 10-1 and 14-1 can be arranged offset to one another or also opposite to one another.

The at least one (elongated or toric) elevation(s) 10-1, 12-1, 12-2 or 14-1 longitudinally extends on the layer 10, 12 or 14 for surrounding or encircling the space or cavity to be sealed against the environment.

In FIGS. 3*a-f*, the elevations 10-1, 12-1, 12-2, 14-1 are illustrated in a rounded or semicircular manner (with respect to their cross-sections). For obtaining the desired sealing functionality, alternative implementations of the cross-section may also be selected, such as triangular, rectangular, etc. Thus, the elevations are each formed, for example, in the form of a bulge, a circumferential ridge or ring and extend, for example, circumferentially in the wall area of the (additionally) to be sealed volume.

The layer 12 may have a thickness $d_{12}$ between two opposing main surface regions thereof in a range of 50 to 300 μm or 100 to 200 μm.

As shown in FIGS. 3*a-c*, the elevation(s) 12-1, 12-2 may have a height $d_1$ (vertical to a main surface region of the layer 12) of 50 to 300 μm or 100 to 200 μm, and a width $d_2$ (parallel to a main surface region of the layer 12) of 50 to 300 μm or 100 to 200 μm.

As shown in FIGS. 3*d* and 3*f*, the part 10 has the elevation(s) 10-1, 10-2 at a surface region thereof, which is adjacent to and in contact with the silicone membrane 12. The elevation(s) 10-1, 10-2 may have a height $d_{10}$ (vertical to the surface region of the part 10) of 50 to 300 μm or 100 to 200 μm, and a width $d_{11}$ (parallel to the surface region of the part 10) of 50 to 300 μm or 100 to 200 μm.

As shown in FIGS. 3*e* and 3*f*, the part 14 has the elevation(s) 14-1, 14-2 at a surface region thereof, which is adjacent to and in contact with the silicone membrane 12. The elevation(s) 14-1, 14-2 may have a height $d_{14}$ (vertical to the surface region of the part 14) of 50 to 300 μm or 100 to 200 μm, and a width $d_{15}$ (parallel to the surface region of the part 14) of 50 to 300 μm or 100 to 200 μm.

Figure 3G:
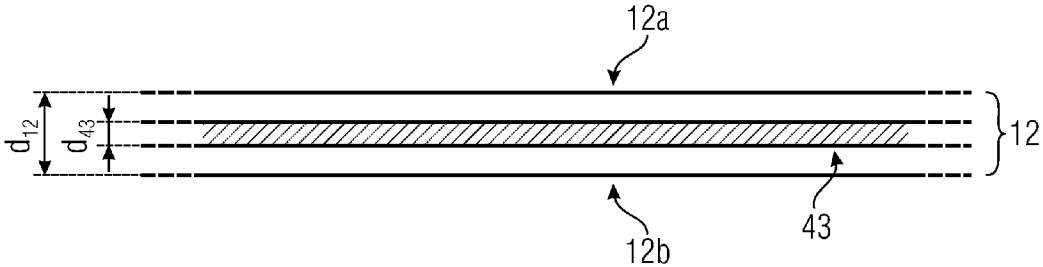

In the arrangement shown in FIG. 3*g*, for example, the second layer 12 implemented as a silicone membrane comprises a metal membrane or metal layer 43 arranged therein. The metal layer 43 is, for example, completely embedded in the layer 12, i.e. surrounded by the same, wherein the metal layer 43 leaves the passages formed by the silicone membrane 3 open. The additional metal layer 43 is fixed, for example, at the clamping points of the second layer 12 between first and third layers 10 and 14. The embedded metal layer 43 is provided to prevent undesired lateral deformation or lateral shift of the silicone membrane 12 when, for example, high pressures are applied to the second layer 12. In this way, a further increase of tightness and reliability of the additional safety valves 40 or 140 (of FIG. 1 or 2) is obtained.

As mentioned above, the layer 12 with the embedded metal layer 43 may have an overall thickness $d_{12}$ between two opposing main surface regions 12*a*, 12*b* in a range of 50 to 300 μm or 100 to 200 μm. Moreover, the metal membrane or metal layer 43 may have a thickness $d_{43}$ in a range of 10 to 100 μm or 30 to 60 μm (with $d_{12} \approx 3 * d_{43}$). The metal layer 43 may comprise stainless steel (e.g. spring steel).

As outlined above, the microfluidic pump arrangement 1, 2 may comprise five patterned layers or parts 10, 12, 14, 16, 18 which are arranged one above the other and which are attached (sequentially) to one another. The different layers or parts 10, 12, 14, 16, 18 may also be subdivided in sub-layers or sub-parts (not shown in the Figures). Thus, at least one of the layers or parts 10, 12, 14, 16, 18 may comprise a plurality of sub-layers or sub-parts, wherein at least one of the layers or parts 10, 12, 14, 16, 18 may be subdivided into sub-layers or sub-parts, for example, in a direction longitudinally and/or vertically with respect to a main surface region thereof.

The inventive pump arrangement having a safety valve structure is especially applicable to the monitoring and regulation of the inside pressure of a (pneumatic) tire based on micropumps. To be more specific, the above described pump arrangement having the specific safety valve structure can be integrated into a tire pressure monitoring and regulating arrangement. Thus, the inventive micropump arrangement can provide a reliable tire pressure monitoring and regulating operation, wherein an undesired or unavoidable leakage especially in the direction from the inside of the pneumatic inflatable structure to the ambience or environment can be prevented or at least greatly reduced.

To summarize, the pump arrangement having a safety valve structure for a free flow protection in a backward direction (with respect to the fluid pumping direction through the microfluidic pump) and optionally an additional second safety valve for free flow protection in a forward direction of the microfluidic pump is therefore especially suited for a fluidic or gas pressure monitoring and regulating application using microfluidic (peristaltic) pumps, and is applicable to pneumatic pressurizers, to pneumatic vibration absorbers or to any pneumatic inflatable structures, such as pneumatic tires for automotives, trucks, bicycles, etc.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A pump arrangement comprising:

a microfluidic pump comprising a pump inlet and a pump outlet, wherein the microfluidic pump is configured to pump a fluid from the pump inlet to the pump outlet, wherein the pump inlet and an inlet of the pump arrangement are fluidically connected;

a safety valve arrangement having a first safety valve and a second safety valve, the first safety valve being arranged between the pump outlet and an outlet of the pump arrangement and comprising a first valve seat and a first valve lid, and the second safety valve being arranged downstream from the pump outlet and including a second valve seat and a second valve lid;

wherein the outlet of the pump arrangement and a first fluid region are fluidically connected and are formed in a first integrated part of the pump arrangement, wherein the first valve lid is formed in a second integrated part of the pump arrangement, wherein the first valve seat, the pump outlet and the pump inlet are patterned in a second surface of a third integrated part of the pump arrangement, wherein the second integrated part is arranged between the first integrated part and the third integrated part of the pump arrangement, wherein the first fluid region is adjacent to the first valve lid, and wherein a pressure in the first fluid region has a closing effect on the first safety valve, wherein the second valve seat is patterned in the second surface of the third integrated part of the pump arrangement, wherein the second valve lid is formed in the second integrated part of the pump arrangement, and wherein the inlet of the pump arrangement and a second fluid region are fluidically connected and are further formed in the first integrated part of the pump arrangement, and wherein the second fluid region is adjacent to the second valve lid, and wherein a pressure in the second fluid region has a closing effect on the second safety valve.

2. The pump arrangement in accordance with claim 1, wherein the second safety valve is arranged between the pump outlet and the first safety valve.

3. The pump arrangement in accordance with claim 1, wherein the second integrated part of the pump arrangement is a flexible layer, wherein the flexible layer forms the first valve lid and second valve lid.

4. The pump arrangement in accordance with claim 3, wherein the flexible layer comprises a silicone diaphragm.

5. The pump arrangement in accordance with claim 1, wherein the first fluid region and the second fluid region are spatially and fluidically separated.

6. The pump arrangement in accordance with claim 1, wherein the pump inlet and the inlet of the pump arrangement are connected fluidically via an opening in the second integrated part.

7. The pump arrangement in accordance with claim 1, wherein the second integrated part comprises a layer of uniform thickness arranged between the third integrated part and the first integrated part wherein one or more openings are formed in the layer of uniform thickness.

8. The pump arrangement in accordance with claim 7, wherein the second integrated part separates the third integrated part and the first integrated part completely.

9. The pump arrangement in accordance with claim 1, wherein the second integrated part comprises a sealing element in form of a ring seal.

10. The pump arrangement in accordance with claim 1, wherein the second integrated part comprises a stabilization element embedded in a silicone material of the second integrated part.

11. The pump arrangement in accordance with claim 1, further comprising a biasing element for biasing the first valve lid towards the first valve seat or for biasing the second valve lid towards the second valve seat.

* * * * *